US007815059B2

(12) United States Patent
Mulholland et al.

(10) Patent No.: US 7,815,059 B2
(45) Date of Patent: Oct. 19, 2010

(54) DISPLAY RACK AND METHOD FOR SUPPORTING CONTAINERIZED PLANTS

(76) Inventors: John Francis Mulholland, 100 Baxter Acres Dr., Manchester, MO (US) 83011; Lee Allen Sturtevant, 54 CR 769, Mountain Home, AR (US) 72653

( * ) Notice: Subject to any disclaimer, the term of this patent is extended or adjusted under 35 U.S.C. 154(b) by 378 days.

(21) Appl. No.: 11/769,403

(22) Filed: Jun. 27, 2007

(65) Prior Publication Data

US 2009/0001035 A1 Jan. 1, 2009

(51) Int. Cl.
*A47G 29/00* (2006.01)

(52) U.S. Cl. ..... 211/85.23

(58) Field of Classification Search ..... 211/88.03, 211/85.23, 175, 186, 189, 85.18, 74, 75, 211/70.6, 34, 36, 37, 191, 46; 248/150, 154, 248/165, 346.3; 269/16, 17; 47/39, 40.5, 47/76, 65, 32.4–32.6
See application file for complete search history.

(56) References Cited

U.S. PATENT DOCUMENTS

| | | | | | |
|---|---|---|---|---|---|
| D23,906 | S | | 12/1894 | Symonds | |
| 617,090 | A | | 1/1899 | Freese | |
| 865,268 | A | * | 9/1907 | Powell | 211/27 |
| 1,063,961 | A | | 6/1913 | Dreyer | |
| 1,112,558 | A | | 10/1914 | Red | |
| 1,153,028 | A | | 9/1915 | Chalk | |
| 1,300,629 | A | | 4/1919 | MaCaw | |
| 2,777,584 | A | | 1/1957 | Dobrin | |
| 2,918,176 | A | * | 12/1959 | Bell et al. | 211/191 |
| 3,032,368 | A | | 5/1962 | Sigler | |
| 3,145,847 | A | * | 8/1964 | Clement | 211/85.23 |
| 3,760,534 | A | * | 9/1973 | Choux et al. | 47/39 |
| 3,778,098 | A | | 12/1973 | Tawara | |
| 3,782,773 | A | | 1/1974 | Mason | |
| 3,784,044 | A | | 1/1974 | Bruggeman | |
| 3,825,126 | A | | 7/1974 | Pohl | |
| 3,852,912 | A | | 12/1974 | Diller | |
| 3,888,353 | A | * | 6/1975 | Leifheit | 211/37 |
| 4,381,838 | A | | 5/1983 | Boogaart | |
| 4,527,694 | A | * | 7/1985 | Bolt et al. | 211/46 |
| 4,601,399 | A | | 7/1986 | Brenteson | |
| 4,604,017 | A | | 8/1986 | Boehm | |
| 4,623,066 | A | | 11/1986 | Talbot | |
| 4,709,955 | A | | 12/1987 | Peters | |
| 4,796,941 | A | | 1/1989 | Reilly | |
| 4,955,490 | A | * | 9/1990 | Schafer | 211/187 |
| 5,233,931 | A | | 8/1993 | McCorkle, Jr. | |

(Continued)

*Primary Examiner*—Jennifer E. Novosad
(74) *Attorney, Agent, or Firm*—Senniger Powers LLP

(57) ABSTRACT

A rack for supporting a plurality of containerized plants has at least one brace supported by and extending between a pair of longitudinally extending rails. The brace is moveable relative to the rails for adjusting the longitudinal position of the brace along the rails such that the brace is positioned to engage at least one of the containers of the containerized plants. In use, one of the containerized plants may be placed in a receiving area defined in part by the brace. The brace may be moved along the rails until the brace engages the container. Then the brace is secured to the rails to resist movement of the brace away from the container along the rails. Some embodiments of the rack are relatively easy to assemble and disassemble. The rack may also be modular to facilitate expansion of the rack to support additional plants.

15 Claims, 16 Drawing Sheets

U.S. PATENT DOCUMENTS 5,330,058 A * 7/1994 Rice ..... 211/4
5,570,540 A 11/1996 Womack
5,673,511 A 10/1997 Holtkamp, Jr.
5,706,956 A * 1/1998 Headrick et al. ..... 211/59.2
5,893,469 A * 4/1999 Nozawa ..... 211/71.01
5,992,647 A * 11/1999 Malik ..... 211/34
6,032,808 A * 3/2000 Henson ..... 211/85.23
6,050,529 A 4/2000 Lin
6,173,846 B1 * 1/2001 Anderson ..... 211/183
6,488,200 B1 12/2002 Jensen, Jr.
6,516,958 B2 * 2/2003 Tyski ..... 211/186
6,637,706 B2 * 10/2003 Kim et al. ..... 248/154
6,814,333 B1 * 11/2004 Freiburger ..... 248/150
6,880,703 B2 4/2005 Peña
7,020,997 B1 4/2006 Thomas
7,036,270 B1 * 5/2006 Shepherd ..... 47/18
7,066,432 B2 * 6/2006 Wood et al. ..... 248/99
7,249,679 B2 * 7/2007 Klein ..... 211/37
7,249,680 B2 * 7/2007 Wang ..... 211/37
2002/0059887 A1 * 5/2002 Marshall et al. ..... 108/39
2004/0238470 A1 * 12/2004 Wishart et al. ..... 211/189
2004/0245200 A1 * 12/2004 Jersey et al. ..... 211/189
2005/0217170 A1 10/2005 Reeves
2006/0043038 A1 * 3/2006 Wetzel et al. ..... 211/88.03
2007/0246434 A1 * 10/2007 Adams et al. ..... 211/8
2009/0077876 A1 * 3/2009 Eghbal et al. ..... 47/18

* cited by examiner

301

DISPLAY RACK AND METHOD FOR SUPPORTING CONTAINERIZED PLANTS

FIELD OF THE INVENTION

The present invention relates generally to the display of containerized plants and more particularly to display racks and methods for supporting one or more plants that are grown or stored in containers.

BACKGROUND

Trees and other relatively large plants or shrubs are often sold by a commercial nursery or a garden center for subsequent transplantation into the ground by a customer. The roots of the plants are typically disposed in a suitable container that also contains soil or another suitable growth or plant food source medium to cover the roots so as to protect the roots from air and to retain moisture. The subsequent transplantation thus involves removing the plant (and typically the accompanying soil) from the container and burying the root system.

Vendors often display containerized plants of this sort by standing the containers upright on a display surface and more typically on the ground or floor. Although the containers typically have a flat base to help keep the tree upright, large plants that are stored or displayed in this manner are at risk of being tipped over by high winds, fork lifts or carts that bump into the plants, or by employees or customers.

This can result in damage to the plant and/or the soil/growing medium falling out of the overturned container, thereby leaving some or all of the roots exposed to air and requiring clean-up efforts and additional labor to set the plants upright again.

There is a need, therefore, for a display rack for supporting containerized plants in a stable, upright orientation.

SUMMARY

One aspect of the invention is a rack for supporting a plurality of containerized plants, each of which includes a plant having an above-ground plant portion and roots connected thereto, and a container containing the roots. The rack has a pair of opposing rail supports. The rail supports have bases for engaging a surface. A pair of longitudinally extending rails extend between and are supported by the rail supports. At least one brace is supported by and extends between the rails. The rails support the brace above the surface when the bases of the rail supports are engaged with the surface. The brace is slidable relative to the rails for adjusting the longitudinal position of the brace along the rails such that the brace is positioned to engage at least one of the containers of the containerized plants.

Another aspect of the invention is a modular rack for supporting a plurality of containerized plants, each of which includes a plant having an above-ground plant portion and roots connected thereto, and a container containing the roots. The rack has three rail supports. The rail supports have bases for engaging a surface. The three rails supports include left and right rail supports and an intermediate rail support positioned between the left and right rail supports. A first pair of rails extends between and is releasably secured to the left rail support and the intermediate rail support. A second pair of rails extends between and is releasably secured to the right rail support and the intermediate rail support. The rack also has a plurality of braces. The braces are supported by the rails. The rails support the braces above the surface when the bases of the rail supports are engaged with the surface. The braces are slidably mounted on the rails for adjusting the positions of the braces along the rails.

Yet another aspect of the invention is a method of holding a plurality of containerized plants. Each of the containerized plants includes a container and a plant. The plant has an above-ground plant portion and roots connected thereto. The container contains the roots. The method includes releasably securing the ends of a pair of rails to a pair of rail supports such that the rails extend between and are supported by the rail supports. A container of one of the containerized plants is placed in a receiving area defined in part by a brace slidably mounted on and extending between the rails. The brace is slid toward the container along the rails until the brace engages the container. The brace is secured to the rails while the brace is engaging the container to resist sliding movement of the brace away from the container along the rails.

Still another aspect of the invention is a display rack for supporting a containerized plant. The containerized plant includes a container and a plant disposed at least in part within the container and extending outward therefrom. The display rack has at least one rail support for supporting the display rack on a support surface. At least two elongate brace rails extend longitudinally of the display rack. The brace rails are supported by the at least one rail support in transversely spaced relationship with each other above the support surface. At least one cross-brace extends transversely between, and is supported by, the brace rails at a longitudinal location along said brace rails above the support surface. The cross-brace is configured to at least in part contact the container of said containerized plant to support said containerized plant in an upright orientation thereof. The at least one cross-brace is moveable relative to said brace rails to selectively adjust the longitudinal location of said cross-brace on said brace rails to any of an infinite number of longitudinal positions along the brace rails.

Various refinements exist of the features noted in relation to the above-mentioned aspects of the present invention. Further features may also be incorporated in the above-mentioned aspects of the present invention as well. These refinements and additional features may exist individually or in any combination. For instance, various features discussed below in relation to any of the illustrated embodiments of the present invention may be incorporated into any of the above-described aspects of the present invention, alone or in any combination.

BRIEF DESCRIPTION OF THE DRAWINGS

Corresponding reference characters indicate corresponding parts throughout the drawings.

DETAILED DESCRIPTION

Figure 1:
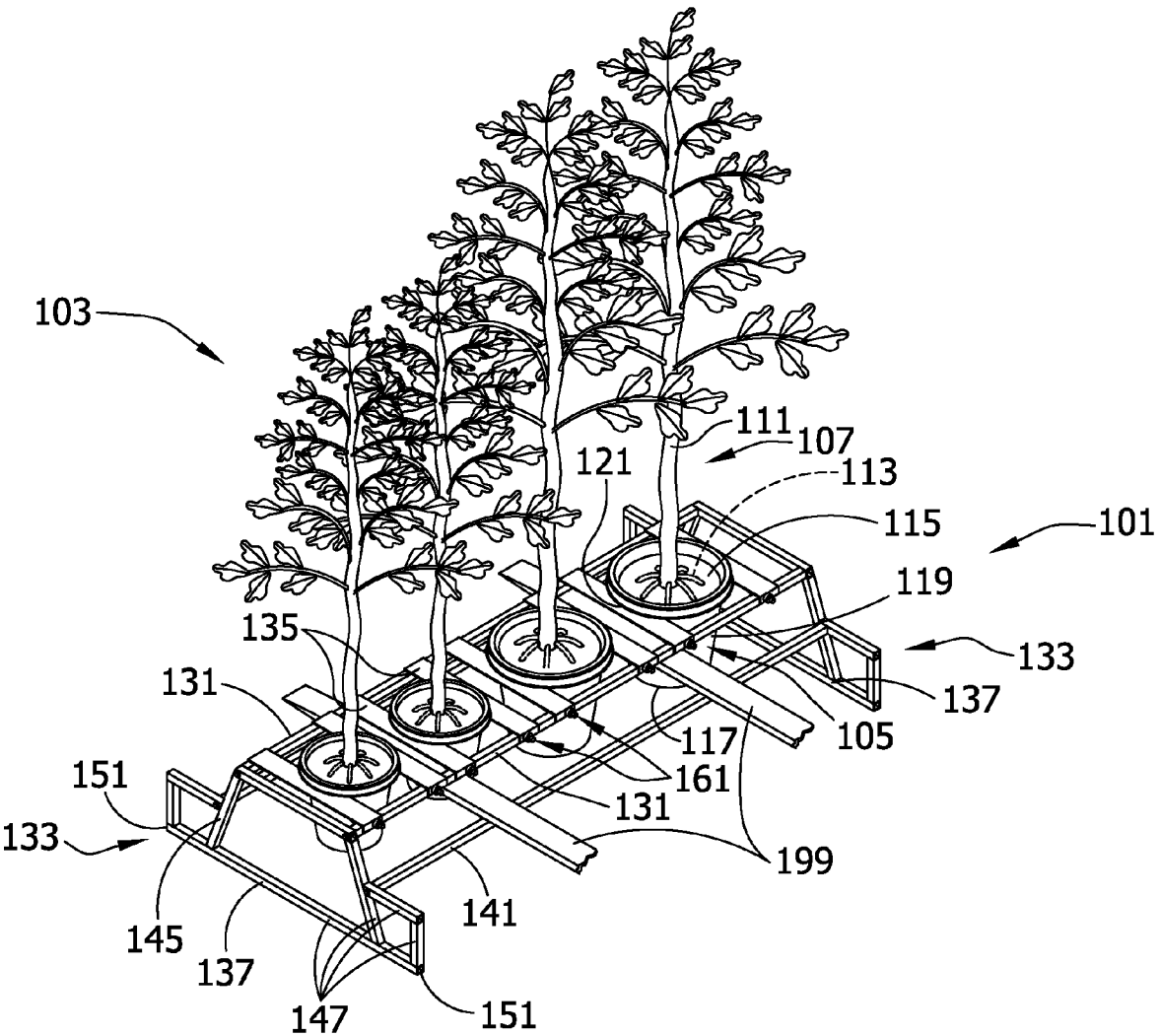
FIG. 1 is a perspective of one embodiment of a display rack for supporting one or more containerized plants in an upright configuration, with containerized plants being supported by the display rack.
Figure 2:
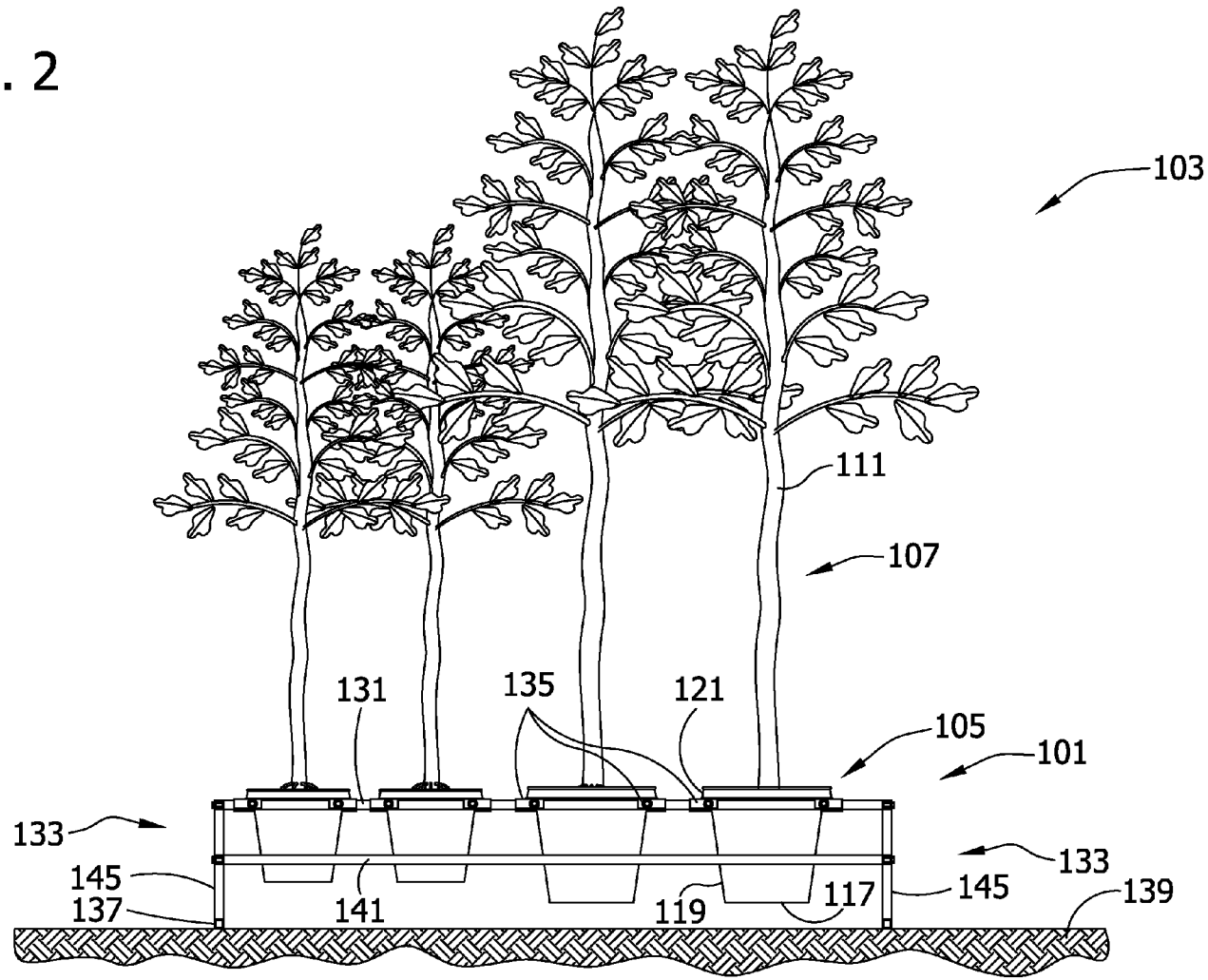
FIG. 2 is a front elevation thereof.
Figure 3:
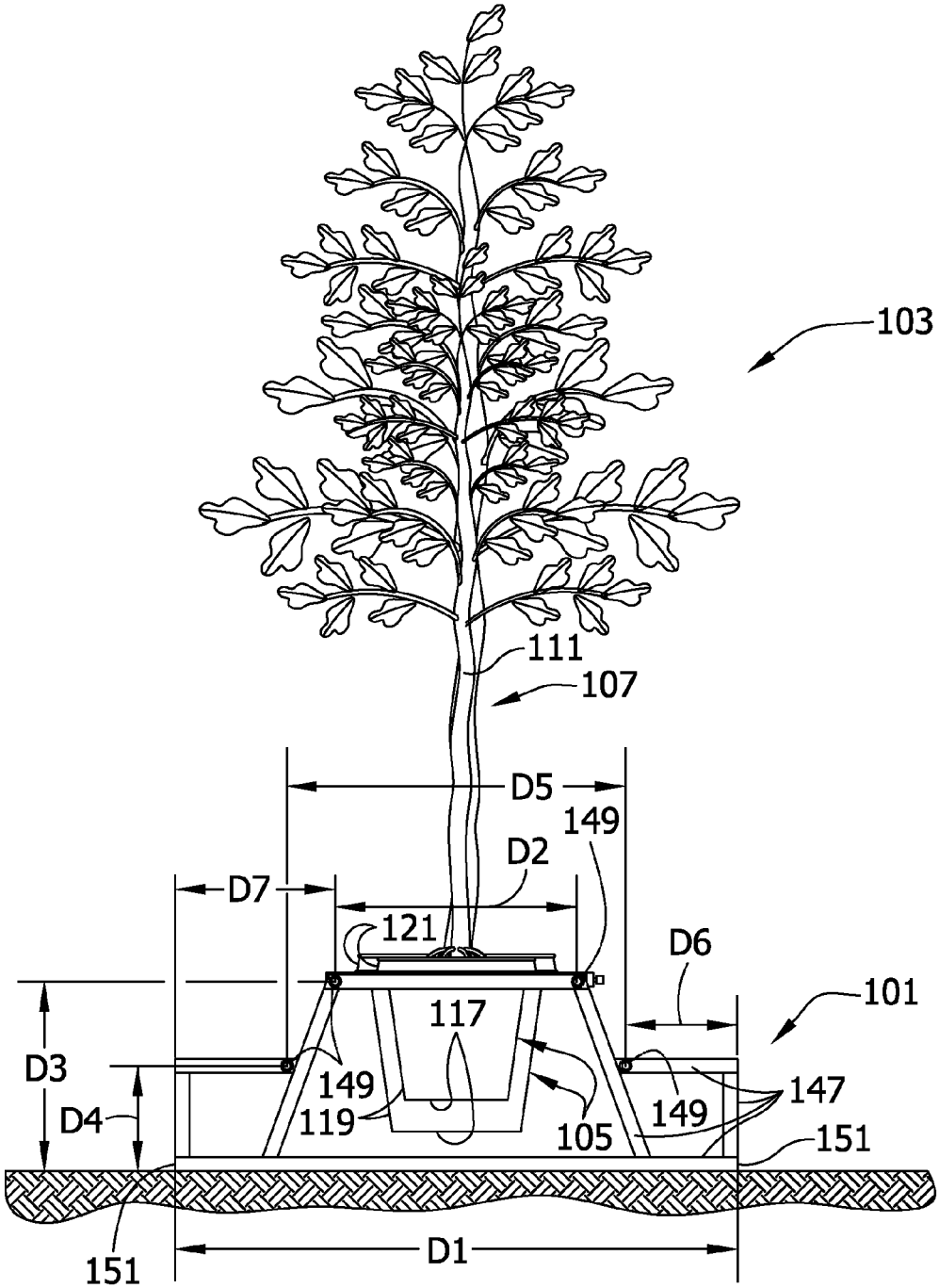
FIG. 3 is a side elevation thereof.

Referring now to the drawings and in particular to FIGS. 1-5, one embodiment of a display rack for supporting one or more containerized plants is generally designated at 101. Containerized plants 103 supported by the display rack 101 conventionally comprise a container 105 (also sometimes referred to as a pot, or a planter) and a plant 107. The plant 107 has an above-ground portion 111 and roots 113 that are contained in the container 105 along with a growth or food source medium 115 (e.g., soil, peat, or the like) to protect the roots from exposure to air and retain moisture. The plant 107 illustrated in FIGS. 1-3 is a tree. However, the term plant as used herein is intended to refer to plants other than trees, such as shrubs, bushes or other plants that may be potted in a container for display and subsequent transplantation.

The container 105 has a flat bottom, or base 117 and a circumferential sidewall 119 extending up from the base at an angle relative to the vertical so that the diameter (broadly, the cross-sectional dimension) of the container increases from the base toward an open top of the container to facilitate removal of the roots 113 and growing medium 115 from the container when it comes time to transplant the plant 107. It is understood, however, that the container 105 may be of uniform cross-sectional dimension along its depth (i.e. height). The container 105 may include a lip 121 extending radially (i.e, transversely out from the sidewall 119 (e.g., at the top of the container) as illustrated in FIG. 1, although it is not uncommon for plant containers to have little or no lip.

The container 105 has a capacity to hold a volume that is large enough to contain the roots 113 and growing medium 115 for the plant 107. Larger plants generally require larger capacity containers. In one embodiment of the invention, the container 105 suitably has a capacity to hold at least about 1 gallon, more suitably at least about 2 gallons, still more suitably at least about 5 gallons, and even more suitably at least about 10 gallons.

It will be understood that the container 105 described above is conventional and is but one example of containers that are used for containing plants to be transplanted at a remote location. Any suitable plant container is considered to be within the scope of the present invention. For example, the plant container 105 of the illustrated embodiment may be constructed of plastic, rubber, metal, clay, ceramic, wire, or other suitable material. Other container shapes and sizes are also contemplated to be within the scope of the present invention. For instance, a piece of burlap (not shown) or other flexible material may be wrapped and secured around the roots and roots 113 and growing medium 115 to contain them within the scope of the invention.

The display rack 101 generally comprises at least two rail supports 133 longitudinally spaced from each other for seating on the ground or floor (broadly, the support surface on which the display rack stands), elongate brace rails 131 supported by the rail supports and extending longitudinally in transversely spaced relationship with each other, and more suitably parallel spaced relationship with each other, and at least one and more suitably at least two cross-braces 135 extending transversely between and supported by the brace rails for supporting a containerized plant 103 on the display rack. In the illustrated embodiment of FIGS. 1-5, an additional pair of rails 141 (that are not used for supporting the cross-braces and therefore are not referred to herein as brace rails) are also supported by the rail supports 133 and extend longitudinally in transversely spaced relationship, and more suitably parallel spaced relationship, with each other.

The rail supports 133 of the illustrated display rack 101 are suitably spaced from each other such that the brace rails 131 and additional rails 141 extend entirely between the rail supports (i.e., the rail supports define the longitudinal ends of the display rack). It is contemplated, however, that the rail supports 133 may be spaced longitudinally nearer to each other with the brace rails 131 and/or the additional rails 141 extending longitudinally outward beyond one or both of the rail supports without departing from the scope of this invention.

The rail supports 133 are of substantially identical construction to each other, with each of the illustrated rail supports being constructed of multiple frame elements 147 that are connected together such as by welding or by suitable fasteners to form a substantially rigid frame 145. In one particularly suitable embodiment, the frame elements 147 comprise metal (e.g., steel) tubing 147 having rectangular cross sections (e.g., at least one inch square in size) and an interior longitudinally extending channel. It is understood, however that the frame elements 147 may be other than rectangular in cross-section, and may be solid. It is also contemplated that these frame elements 147 may other than metal, such as wood, plastic, or other suitable material capable of retaining the weight of the containerized plants without buckling or breaking. In other embodiments the rail supports may be other than a frame comprised of multiple frame elements, such as a separate pair of transversely spaced legs or support posts, or of a single piece construction such as a molded piece or a piece cut from wood or metal stock.

The base 137 of the rail support 133 illustrated in FIG. 3 suitably comprises an elongate frame element of the frame 145 that defines the outermost transverse sides 151 of the rail support 133 (and hence of the display rack 101). The base 137 also has a footprint D1, which refers herein to the transverse spacing between locations at which the rail support contacts the support surface 139 on which the display rack stands, defined by the length of the elongate frame element that forms the base. In one particularly suitable embodiment the footprint D1 of the rail support base 137 is greater than a transverse spacing D2 between the brace rails 131 to provide stability to the rack 101 against the rack itself tipping over once containerized plants 103 are supported by the rack. As one example, the footprint D1 of the illustrated base 137 is suitably in the range of about 3 to about 4 feet while the transverse spacing D2 between the brace rails 131 is in the range of about 1 to about 2.5 feet. It is understood, though, that the base footprint D1 and/or the brace rail spacing D2 may be other than as set forth above depending on the size of the display rack, and that the footprint D1 may be substantially equal to the brace rail spacing D2 without departing from the scope of this invention.

However, the spacing D2 between the brace rails 131 is in any event at least as great as and more suitably greater than the cross-sectional dimension of the base 117 of the container 105 to allow the container to be positioned between the brace rails. In the embodiment illustrated in FIGS. 1-5, the spacing D2 between the brace rails 131 is suitably greater than the largest cross sectional dimension of the container 105 (e.g., the cross sectional diameter of the top of the tapered container). In other embodiments (not shown) in which the container 105 has a tapered side wall 119 (e.g., the cross-section dimension increases from the base 117 to the top of the container), the spacing D2 is suitably no greater than and is more suitably less than the cross-sectional dimension of the top of the container such that the brace rails 131 may engage sidewall 119 of the container.

It is also contemplated that in other embodiments (not shown) the base 137 of the rail support 133 need not be a single piece or otherwise generally continuous element. For example, the base 137 may instead comprise two or more legs or support posts that are spaced transversely from each other such that the transverse outermost legs define the transverse sides of the rail support. It is even contemplated that each rail support may comprise two or more discrete, transversely spaced members, such as two non-connecting legs or support posts or two separate frames, each supporting a respective one of the brace rails 131. In such an embodiment, the transverse spacing between the brace rails may be adjusted by the spacing of the rail support members.

The illustrated brace rails 131 as well as the additional rails 141 are suitably constructed of an elongate metal tube that is generally square in cross-section and has a longitudinally extending interior channel. The rails 131, 141 are suitably open at their longitudinally opposite ends for connecting the rails to the rail supports 133 as will be described later herein. It is understood, however, that the rails 131, 141 may be constructed of wood, plastic or other suitable material capable of supporting the weight of the containerized plants 103 held by the display rack 101. It is also understood that the rails 131, 141 may be other than square in cross-section, and/or solid instead of a tube, without departing from the scope of this invention.

With reference to FIGS. 1 and 3, the additional rails 141 are disposed lower (e.g., closer to the support surface 139 upon which the display rack 101 stands) than the brace rails 131 and transversely outward from the brace rails to provide additional stability to the display rack as well as to provide for lifting the entire display rack (with containerized plants 103 therein) without disturbing the containerized plants as will be described later herein. As an example, the illustrated rails 141 are disposed a distance (i.e., at a height) D4 above the support surface in the range of about 4 to about 8 inches while the brace rails 131 are disposed a distance D3 from the support surface of about 0.75 to about 3 feet (e.g., about 0.75 to about 2 feet). These additional rails 141 are also space transversely from each other a distance D5 greater than the spacing D2 of the brace rails 131, with the additional rails spaced transversely inward from the side 151 of the rail support a distance D6 that is less than the transverse spacing D7 of the brace rails 131 from the side 151 of the rail support 133. As a further example, the distance D6 of the illustrated display rack 101 is suitably in the range of about 4 to about 16 inches, and more suitably in the range of about 6 to about 10 inches, and still more suitably in the range of about 8 to about 9.5 inches.

It is understood, however, that the spacings D2, D3, D4 D5 and/or D6 may be other than as set forth in the above example without departing from the scope of the invention. It is also contemplated that the spacing D6 of the additional rails 141 from the respective sides 151 of the rail supports 133 may be substantially equal to the spacing D7 of the brace rails 131 from the sides of the rail supports (i.e., the spacing between the additional rails 141 may be equal to the spacing D2 between the brace rails 131).

Figure 5:
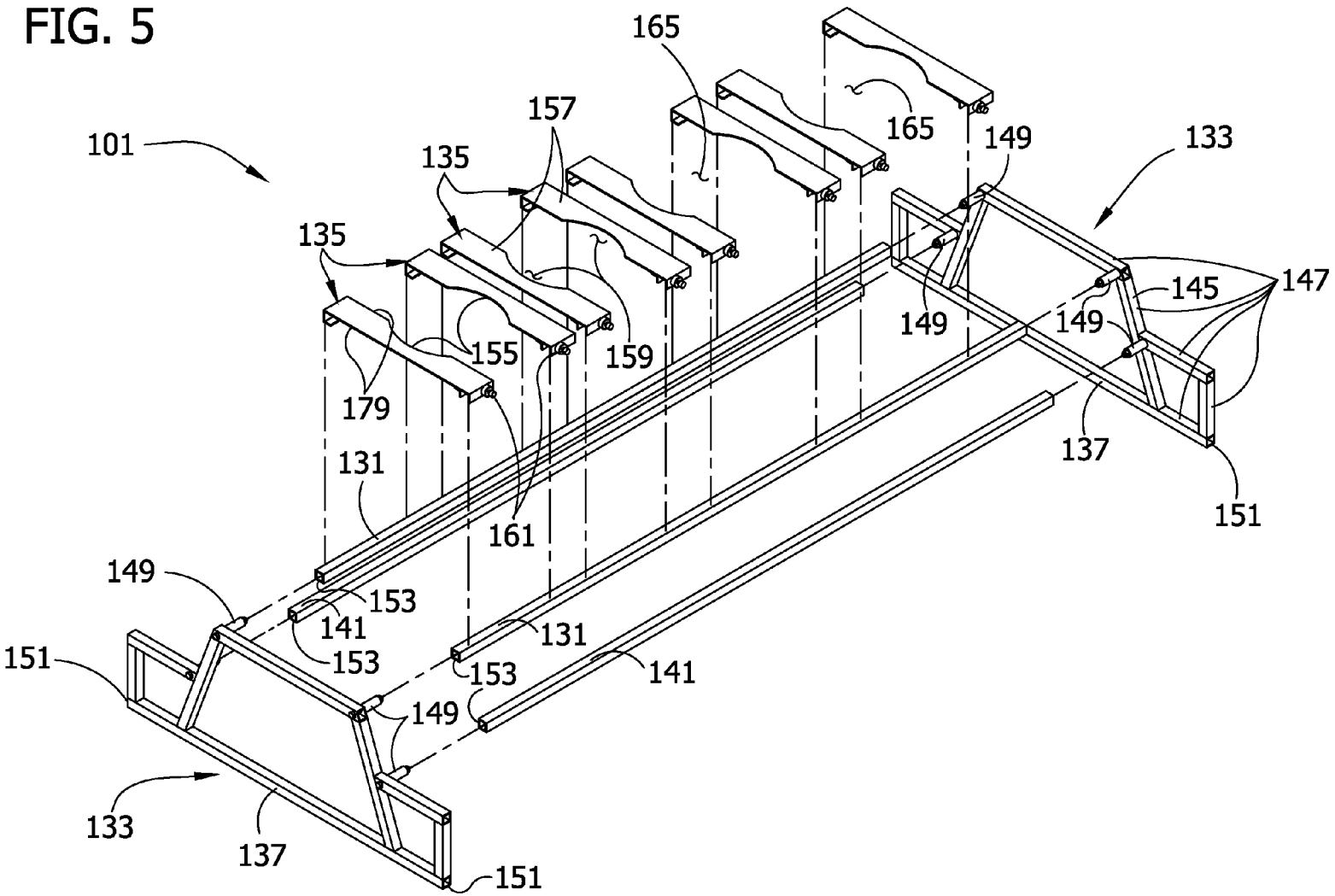
FIG. 5 is an exploded view of the rack of FIGS. 1-3, with the containerized plants omitted.

As best illustrated in FIG. 5, the brace rails 131 are suitably releasably connected to the rail supports 133, such as by rail mounts 149, to allow for disassembly and storage/transportation of the display rack 101 in a disassembled condition. The illustrated rail mounts 149 are generally in the form of cylindrical pins that are secured to and extend longitudinally from the frames 145 (i.e., from the rail supports 133). These pins 149 are suitably sized in cross-section for insertion into the open longitudinal ends 153 of the brace rails 131 and additional rails 141, and more suitably sized in cross-section for friction or interference fit with the brace rails within the longitudinal channels therein. It is understood, though, that the brace rails 131 and additional rails 141 may be releasably connected to the rail supports 133 by other suitable means without departing from the scope of this invention. It is also contemplated that the brace rails 131 and/or the additional rails 141 may be more permanently secured to the rail supports, such as by being welded thereto or formed integrally therewith.

Figure 4:
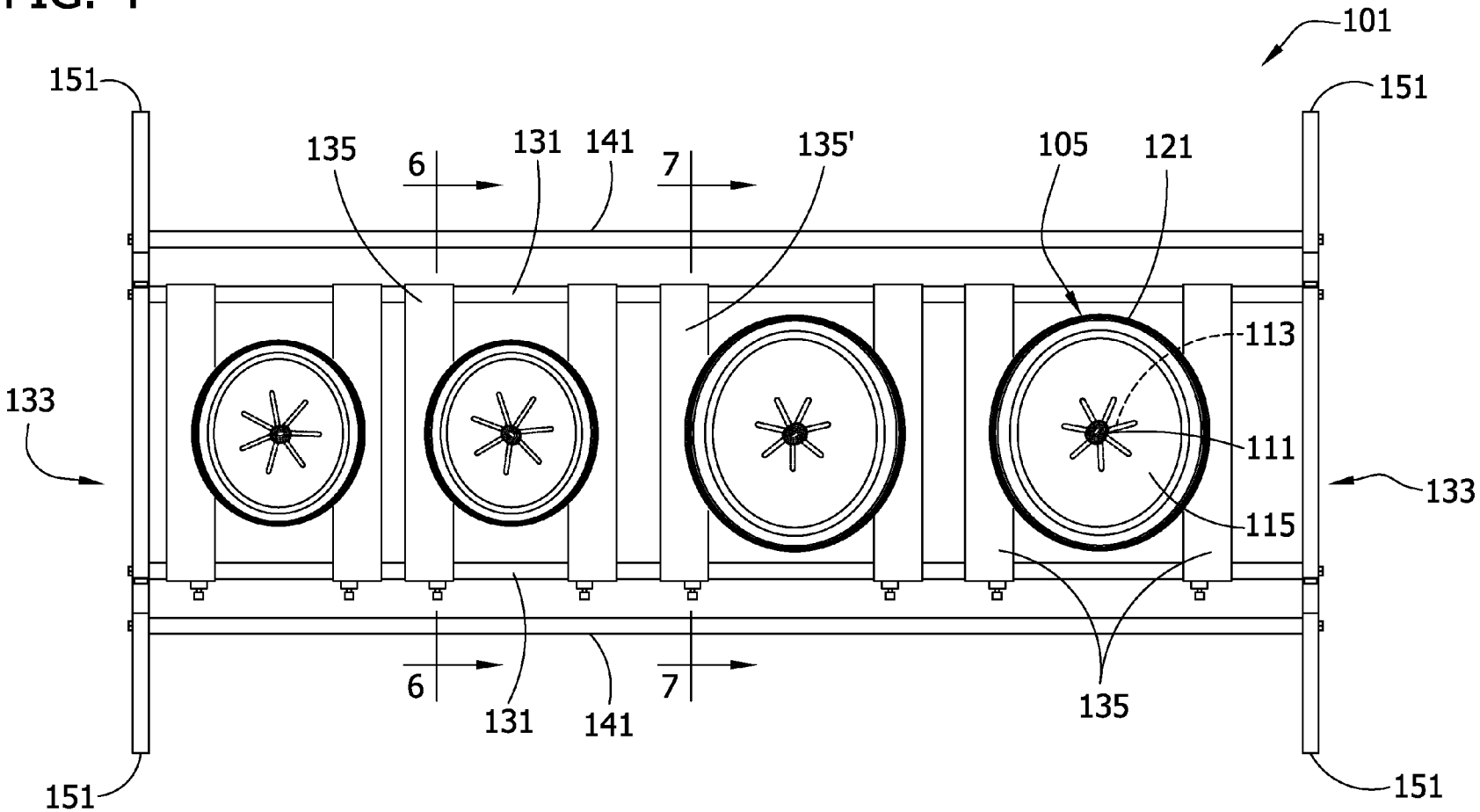
FIG. 4 is a top plan view thereof, with upper portions of the containerized plants cut away.
Figure 6:
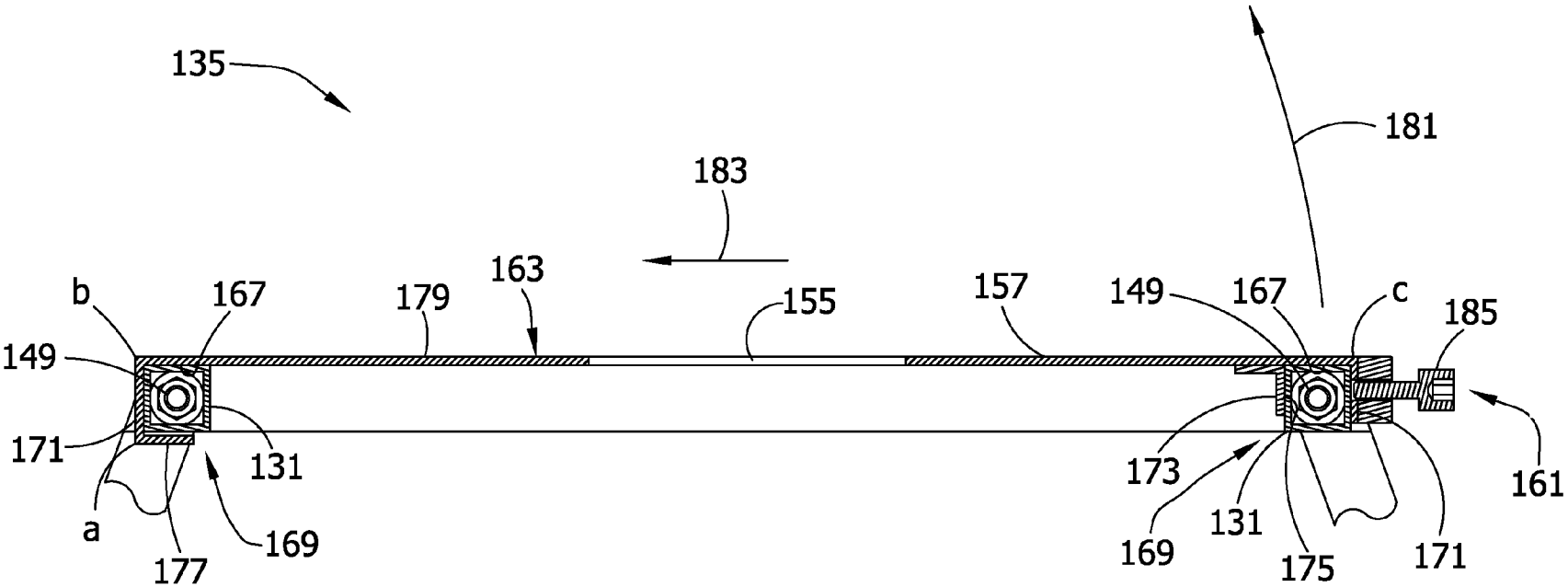
FIG. 6 is a cross section taken in the plane including line 6-6 of FIG. 4 wherein the section is taken through one embodiment of a cross-brace of the display rack.

With particular reference now to FIGS. 4-6, the cross-braces 135 are suitably configured for mounting on the brace rails 131 and supporting the containerized plants 103 in the display rack 101. More suitably, one or more of the cross-braces 135 is configured to permit adjustment of the longitudinal location of the cross-brace relative along the brace rails 131, and even more suitably to permit sliding movement of the cross-brace along the brace rails 131. For example, each of the illustrated cross-braces 135 comprises an elongate support member 163 and a pair of transversely spaced mounting assemblies 169 at or adjacent transversely opposite sides of the elongate support member for mounting the cross-brace on the brace rails 131. In particular, the mounting assemblies 169 are spaced from each other in accordance with the spacing D2 between the brace rails 131.

As illustrated best in FIG. 5, the support member 163 of each cross-brace 135 is in the form of a generally rectangular panel having longitudinally opposite sides 179 that extend the length of the support member between the mounting assemblies 169 of the cross-brace. In one particularly suitable embodiment, at least a segment 155 of one longitudinal side 179 of the support member is non-linear, or contoured (and in the illustrated embodiment, arcuate) in general accordance with the contour of the container side wall 119. It is understood, however, that the longitudinal sides 179 of the cross-brace 135 support member 163 may each be contoured in this manner, or the contours of each longitudinal side of the support member may be different to accommodate different shaped or sized containers 105. It is also contemplated that the longitudinal sides of the support member may both be straight within the scope of this invention. Also, while the cross-brace support member 163 of the illustrated embodiment is in the form of a panel, it is understood that the support member may have any suitable form such as a rod, beam, tube or other structure that is capable of contacting and supporting the containerized plants 103.

The mounting assemblies 169 of each cross-brace 135 of the illustrated embodiment suitably comprise a flange member 171 depending from and connected to (such as by being formed integrally with or being formed separate from and secured to) the support member 163 of the cross-brace 135 generally at the transversely opposite sides of the support member. The flanges 171 are spaced from each other and located on the cross-brace 135 such that the flanges seat down over the outsides of the respective brace rails 131 as illustrated in FIG. 6, with the underside of the support member 163 resting on (i.e., supported by) the tops of the brace rails. One of the mounting assemblies 169 (i.e., at one transverse side of the cross-brace 135, further comprises a transverse member 177 connected to and extending transversely inward from the flange 171 in spaced relationship with the support member 163 of the cross-brace with the spacing being generally in accordance with the vertical cross-sectional dimension of the brace rail. The mounting assembly 169 at the opposite transverse side of the cross-brace 135 further comprises a stop member 173 (such as in the form of an angle iron as illustrated in FIG. 6 or other suitable form) depending from the underside of the cross-brace support member 163 in transversely spaced relationship with the corresponding flange member 171 with the spacing being in accordance generally with the transverse cross-sectional dimension of the brace rail 131.

In this configuration, the mounting assembly 169 having the transverse member 177 inhibits lifting of that side of the cross-brace 135 off of the brace rail 131 while the stop member 173 of the opposite mounting assembly and the flanges 171 inhibit transverse movement of the cross-brace on the brace rails. Such a cross-brace configuration allows the illustrated cross-braces 135 to be removeable from the brace rails 131 as well as to be slidable longitudinally along the brace rails when mounted thereon. It is understood, however, that the mounting assemblies may be constructed other than as described above and illustrated herein.

Each of the illustrated cross-braces 135 further comprises a locking system 161 for inhibiting the cross-brace against sliding movement relative to, or removal of the cross-brace from, the brace rails 131. The locking system 161 of the embodiment of FIG. 5, for example, is a resistance type locking system including a set screw positioned in the mounting assembly 169 for tightening the set screw against the brace rail 131 to increase resistance to movement of the cross-brace 135 relative to the brace rail 131. Loosening the set screw 185 allows sliding movement of the cross-brace 135 on the rails 131. This locking system 161 allows the cross brace 135 to be adjusted to any of an infinite number of longitudinal positions along the brace rails in contrast to systems that allow the cross brace to be adjusted to only one of a plurality of predetermined or indexed positions (e.g., as in a locking system having a spring-biased detent that engages recesses or openings when the cross brace is in one of the predetermined or indexed positions). It is contemplated that other suitable locking systems may be used, including locking systems that do not allow adjustment of the cross brace to an infinite number of longitudinal positions, or that the locking system may be omitted, without departing from the scope of the invention.

The cross-brace 135 illustrated in FIG. 6 may be removed from the brace rails 131 (and hence the display rack 101) by releasing the locking mechanism 161 and lifting the locking mechanism side of the cross-brace up off of the brace rail, as indicated by the arrow 181 in FIG. 6. There is suitably enough flex in the cross-brace 135 and/or brace rails 131 to allow the end of the cross-brace to be lifted high enough to provide clearance between the depending flange 171 of the mounting assembly and the rail 131. Then the cross-brace 135 can be moved transversely in the direction of arrow 183 (FIG. 6) until the transverse member 177 of the opposite mounting assembly 177 clears the other brace rail 131, thereby allowing the cross-brace to be completely removed from the brace rails 131 without separating the rails from the rail supports 133.

Figure 7:
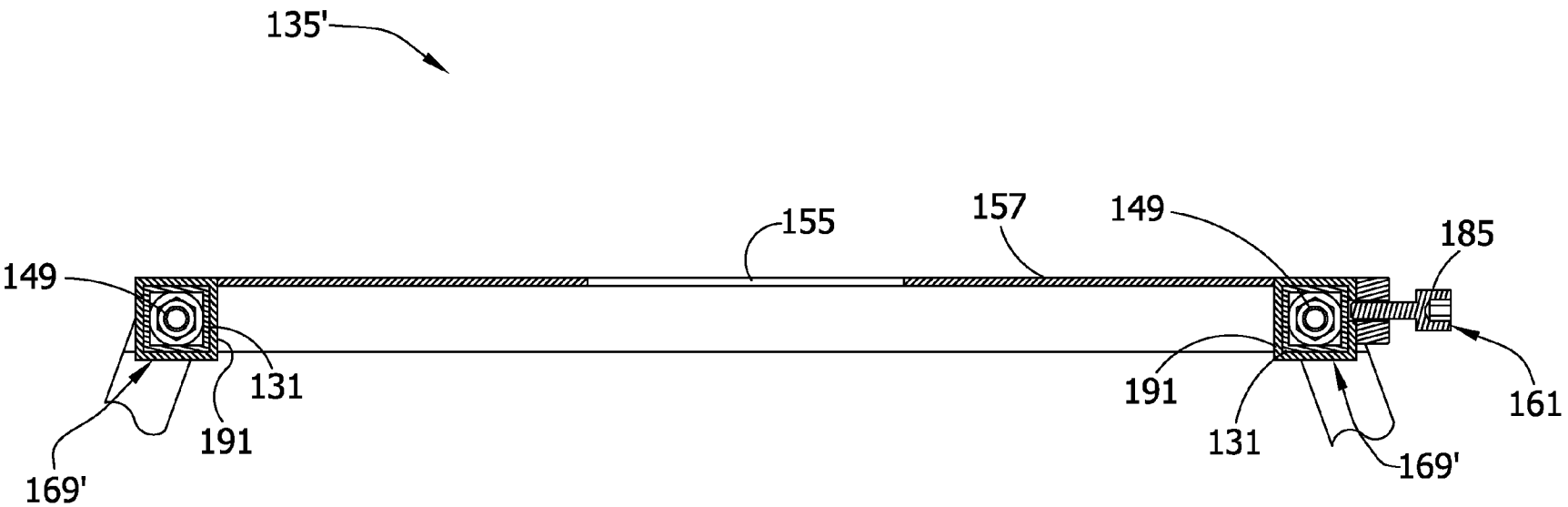
FIG. 7 is a cross section taken in a plane including line 7-7 of FIG. 4 wherein the section is taken through a second embodiment of a cross-brace of the display rack.

FIG. 7 illustrates an alternative embodiment of a cross-brace 135' constructed for sliding movement on the brace rails 131 but otherwise not removeable from the brace rails without some disassembly of the display rack 101. This makes the cross-brace 135' more resistant to unauthorized removal of the cross-brace from the rack 101, or inadvertent loss of the cross-brace. The mounting assemblies 169' at the transverse sides of the cross-brace 135' each comprise a hollow tube segment 191 sized for receiving a respective one of the brace rails 131 therethrough. To mount the cross-brace 135' on the brace rails 131, the mounting assemblies 169' of the cross-brace are placed onto the brace rails (e.g., with the rails extending through the tube segments 191 of the mounting assemblies) before the rails are secured to the rail supports 133. Removal of the cross-brace 135' from the brace rails 131 similarly requires disassembly of the rails from the rail supports 133 and the sliding of the cross-brace off of the rails. The cross-brace 135' of the embodiment of FIG. 7 includes a locking system 161 similar to that illustrated in FIG. 6 to substantially secure the cross-brace in its desired longitudinal location along the brace rails 131.

It is also contemplated that in other embodiments the cross-brace may be configured so as to be removable from one of the brace rails 131 while being non-removable (but still slidable along) the other brace rail without some disassembly of the display rack. For example, while not illustrated in the drawings, one of the brace rails (or both) may be cylindrical and the mounting assembly tube segment (similar to that of FIG. 7) may be cylindrical tube segment that receives the cylindrical brace rail therethrough to allow pivoting movement of the cross-brace about the brace rail.

As best illustrated in FIGS. 4 and 5, in one embodiment the cross-braces 135 are arranged on the brace rails 131 in corresponding pairs of opposed cross-braces, with each pair of opposed cross-braces being used to define container holding areas 167 in which the containerized plant 103 is supported in the display rack 101. In particular, the contoured segments 155 of each of the opposed cross-braces 135 face each other to together hold a containerized plant 103 therebetween with the contoured segments abutting against the side wall 119 of the container 105. Providing multiple pairs of opposed braces 135 as illustrated in FIGS. 4 and 5 thus allows for a plurality of containerized plants 103 to be supported by the display rack 101. In particular, because the cross-braces 135 are adjustable longitudinally along the brace rails 131, containerized plants 103 of different sizes may be supported by the display rack 101 at the same time. Further, braces 135 can be added to the rails 131 (or removed therefrom) depending on the need to accommodate a certain number and/or certain sizes of the containerized plants 103.

Figure 8A:
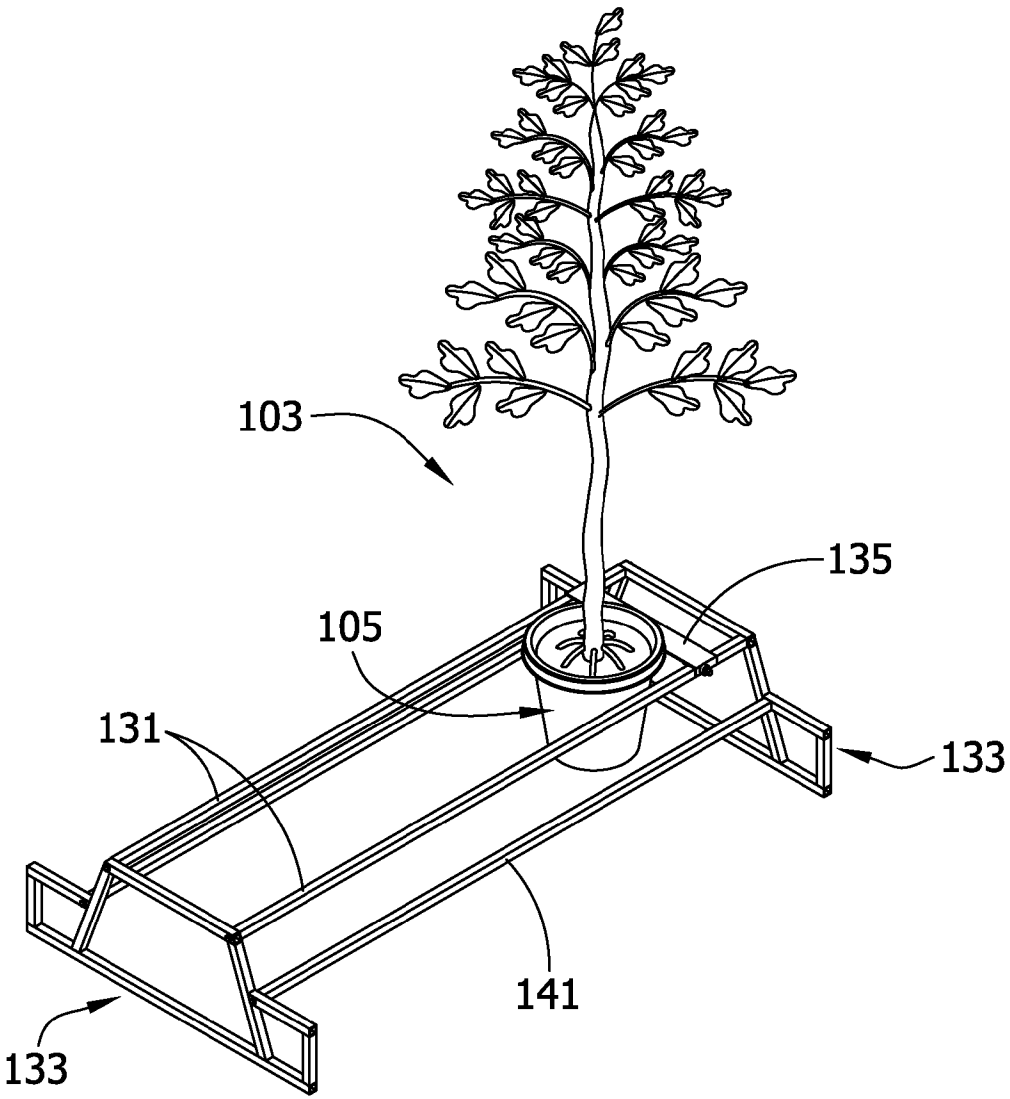
FIGS. 8A-8D illustrate a sequence in which a containerized plant is displayed in the rack of FIGS. 1-5 according to one embodiment of a method of supporting a containerized plant.
Figure 8B:
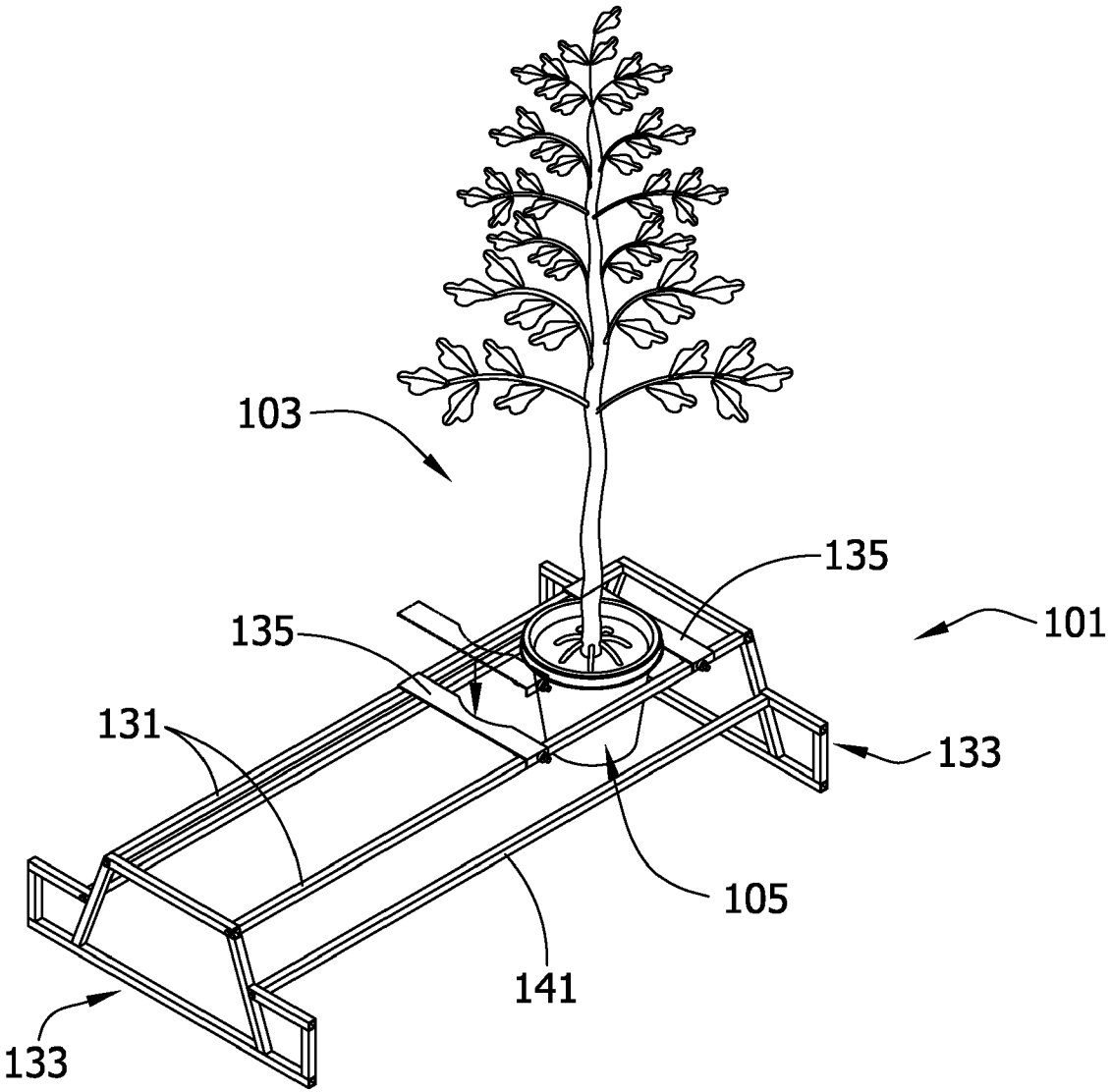
Figure 8C:
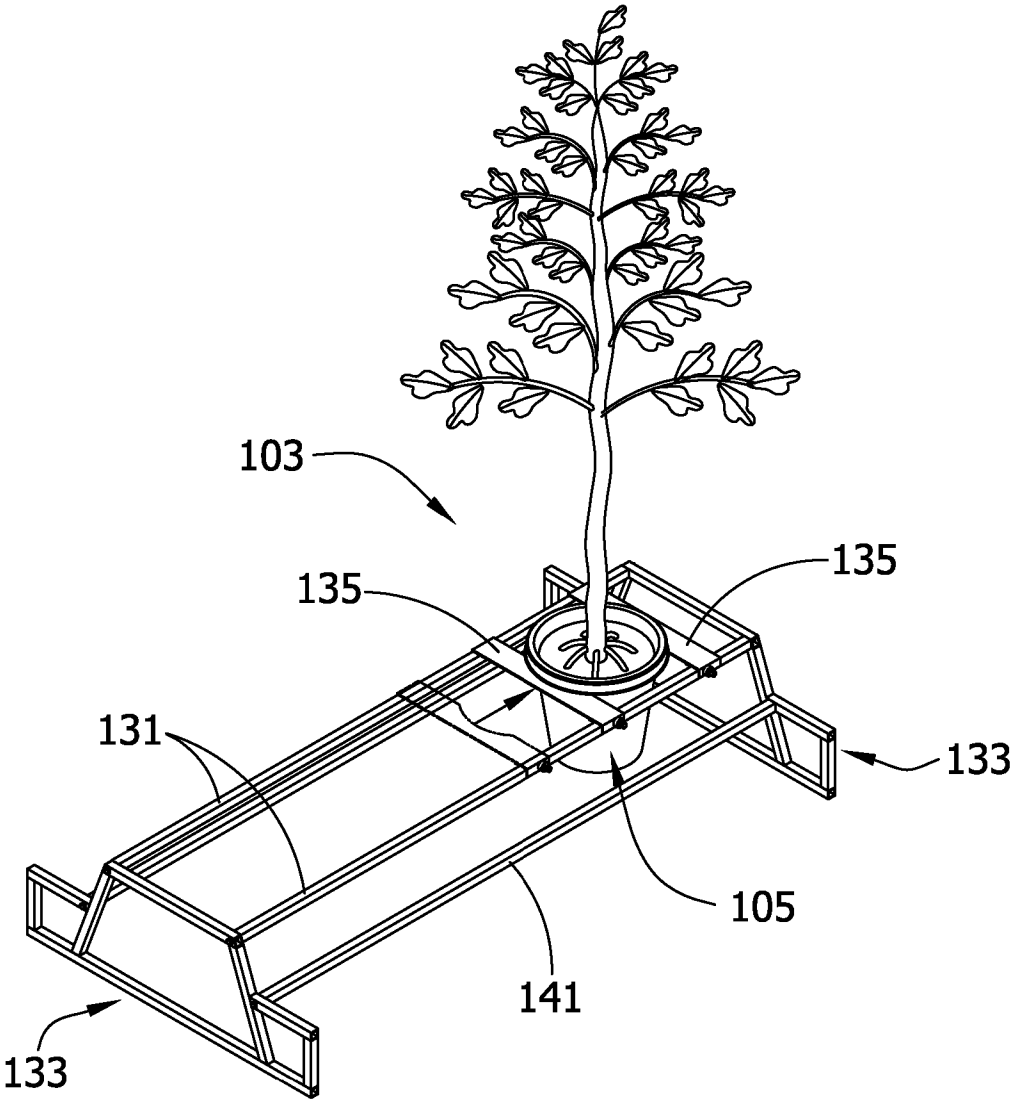

FIGS. 8A-8D illustrate a sequence in which a pair of cross-braces 135 of the display rack 101 are used to support a containerized plant 103 therein according to one embodiment of a method for supporting a containerized plant in an upright orientation. As illustrated in FIG. 8A, one of the cross-braces 135 is mounted on the brace rails 131 at a desired longitudinal location along the rails and is generally secured against longitudinal movement by the locking system 161. The container 105 of the containerized plant 103 is placed between the brace rails 131 adjacent the contoured segment 155 of the cross-brace 135. For example, the side wall 119 of the container 105 is suitably positioned against (e.g., in contact with) the contoured segment 155 of the cross-brace 135. The other cross-brace 135 (e.g., from an opposed pair of the cross-braces) is then mounted on the brace rails 131 (FIG. 8B) on the longitudinally opposite side of the container 105 in spaced relationship with (e.g., out of contact with) the container 105. It is understood that the second cross-brace 135 may alternatively be mounted on the brace rails 131 in sufficiently spaced relationship with the first cross-brace prior to the container 105 being positioned therebetween. As illustrated in FIG. 8C, the second cross-brace 135 is then slid along the brace rails 131 until the contoured segment 155 of the second cross-brace contacts the side wall 119 of the container 105 to secure the container between the cross-braces.

Figure 8D:
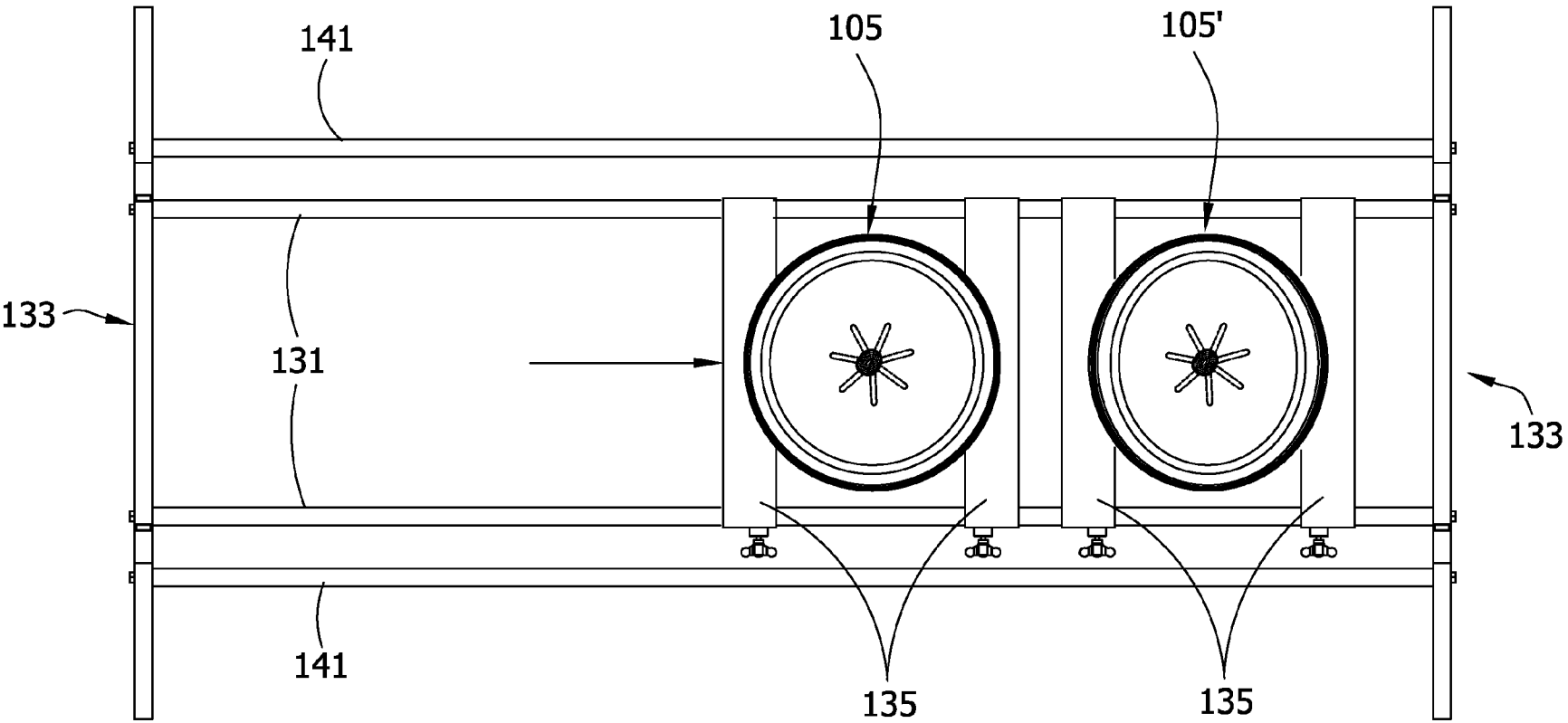

In some embodiments, such as where the container 105 is sufficiently flexible, enough squeezing force may be applied to the container side wall 119 by the opposed pair of cross-braces 135 to slightly deform the container (e.g., from its initial generally circular shape to a slightly oval shape). FIG. 8D, for example, illustrates one container 105' that has been squeezed into a deformed (oval) shape by the cross-braces 135 of the display rack 101 and an undeformed container 105 that is still generally circular in shape. Deforming the container 105' in this manner not only ensures that the container is clamped securely in the rack 101 by the cross-braces 135, but also allows the container to pivot or rock a little bit between the cross-braces 135 (e.g., as the containerized plant 103 sways in the wind) while remaining securely clamped between the braces. Once the container 105' of the containerized plant 103 is clamped between the braces 135, the locking system 161 of the second cross-brace is set to the state in which it resists movement of the brace along the rails 131 (e.g., by tightening the set screw 185).

With reference to FIGS. 2 and 3, when the containerized plant 103 is clamped in the display rack 101, the container 105 is suitably supported above the support surface 139 by the cross-braces 135. In the illustrated embodiment the cross-braces 135 suitably contact the container sidewall 119 near the top of the container, and more suitably just below the lip 121 of the container where such a lip is present. In another embodiment, the cross-braces 135 suitably engage the container 105 at a location that is closer to the top of the container 105 than its base 117, more suitably at least about two thirds of the way from the base of the container to its top, and still more suitably at least about three fourths of the way from the base of the container to its top. The process is repeated with additional containerized plants 103 until each of the plurality of containerized plants that is to be supported by the display rack 101 is clamped into and supported by the rack (e.g., as illustrated in FIGS. 1-4).

The display rack 101, with or without containerized plants 103 supported in the rack, is suitably transportable without removing the plants from the rack and/or disassembling the rack. For example, as illustrated in FIG. 1, the brace rails 131 and additional rails 141 are arranged relative to each other as discussed previously herein so as to allow a fork lift 199 (or fork lift attachment to a front end loader) to be positioned under the lower rails 141 and lift the rack 101 together with all of the containerized plants 103 held thereon. The fork lift 199 can carry the display rack 101 to its desired location and set it on the support surface 139. Transporting the rack 101 in this manner allows a relatively long rack or rack subsection (e.g., up to about 12 feet or more in length) and the plants 103 thereon to be moved together as a unit by the fork lift 199.

While in the illustrated embodiments all of the cross-braces 135 are at least slidable longitudinally along the brace rails 131 (if not entirely removeable therefrom), it is understood that one or more of the cross-braces may be permanently secured to the brace rails against removal from and sliding thereon. For example, a pair of fixed cross-braces may be used as an opposed pair of braces so as to define a fixed container holding area 167 therebetween for holding a set size or range of sizes of the containers 105. In other embodiments, a respective pair of cross-braces 135 may comprise a fixed cross-brace and an adjustable cross-brace. It is understood that the number of cross-braces 135 used may vary depending on the number of containerized plants 103 to be supported by the display rack 101. It is even contemplated that a single adjustable cross-brace 135 may be used, e.g., in combination with one of the rail supports 133, to support a containerized plant 103 therebetween.

Figure 9A:
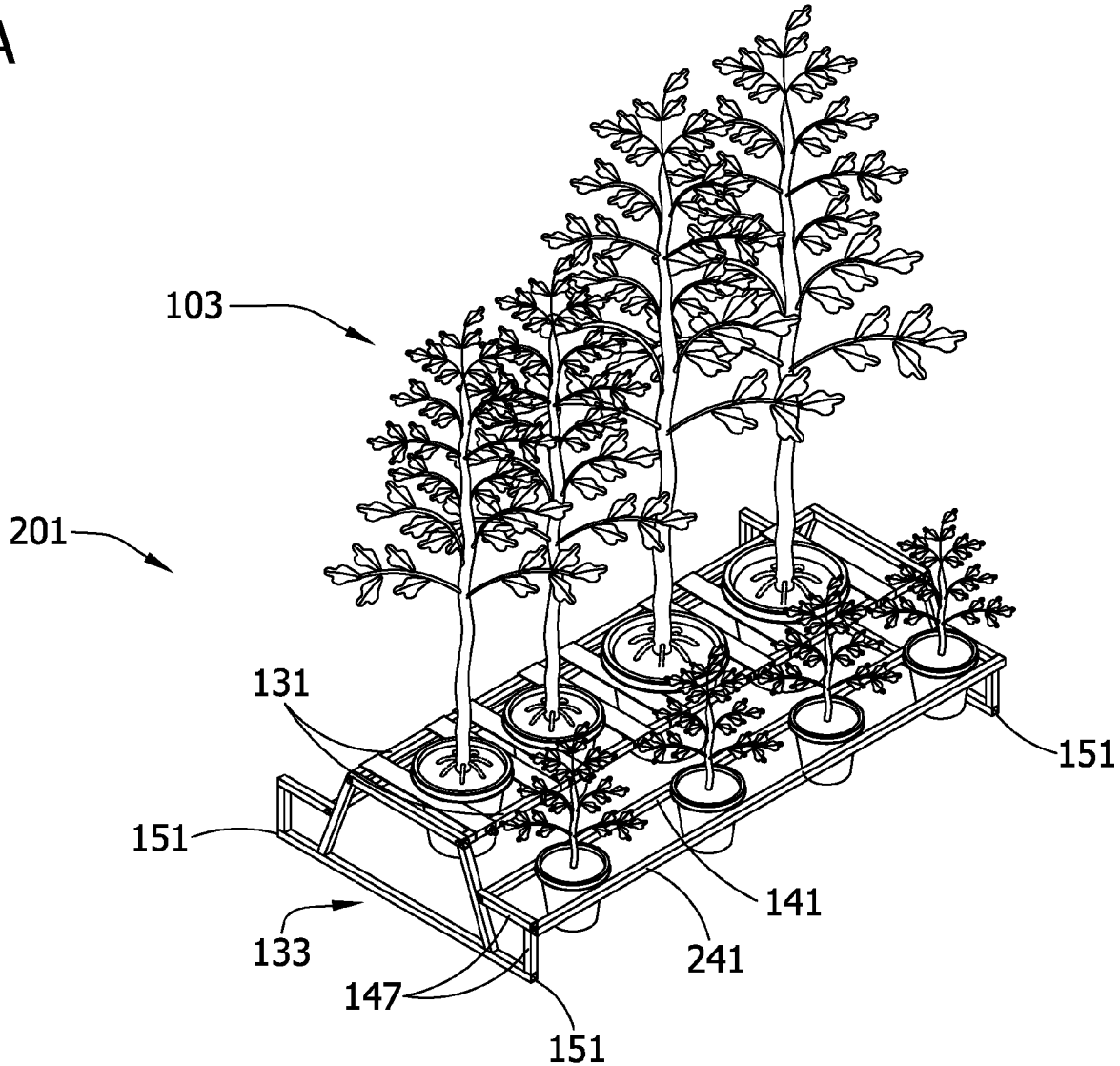
FIG. 9A is a perspective of a second embodiment of a display rack for supporting one or more containerized plants.
Figure 9B:
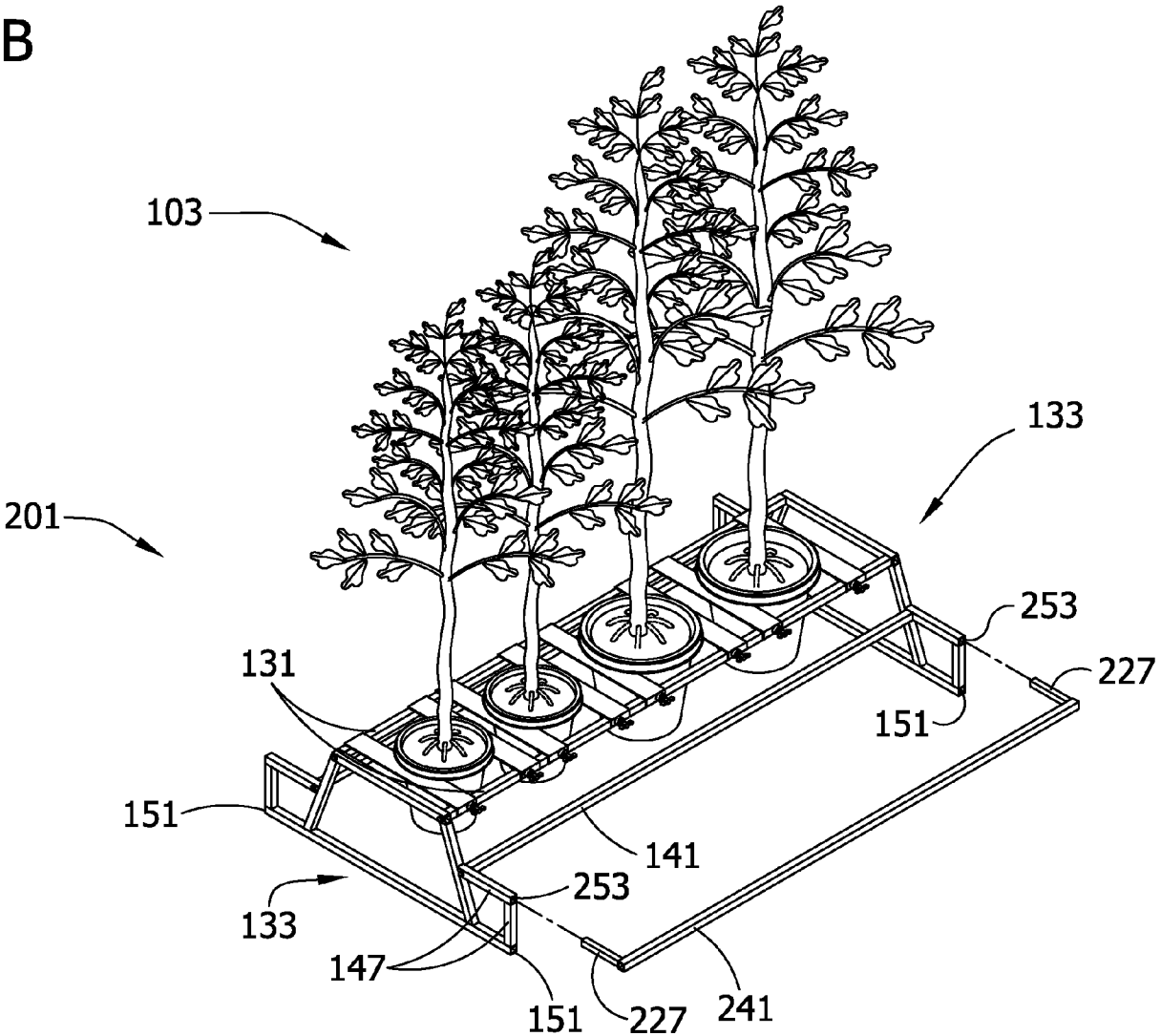
FIG. 9B is a partially exploded view of the display rack of FIG. 9A illustrating one way of securing a secondary rail to the rack.
Figure 9C:
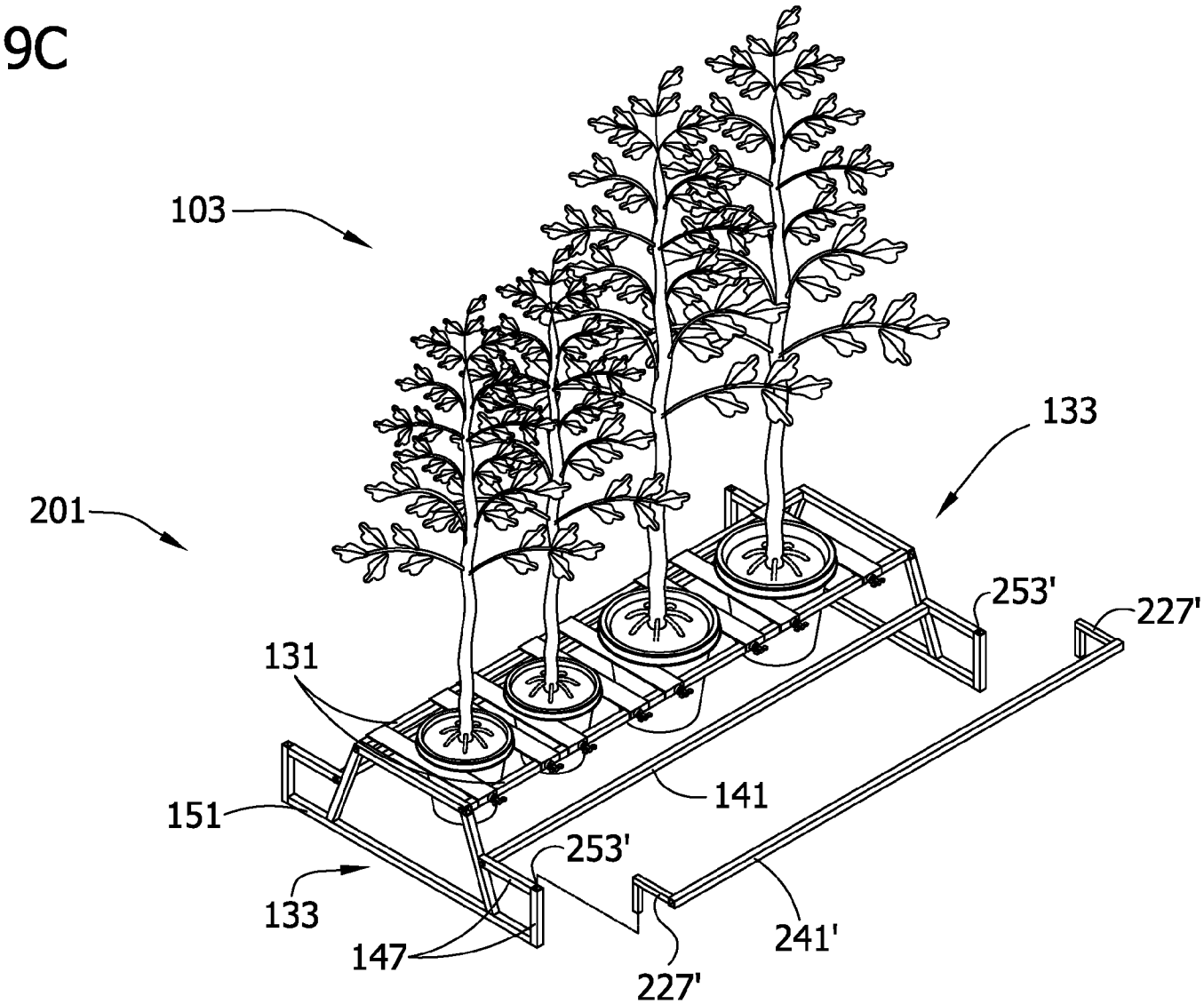
FIG. 9C is a partially exploded view of another embodiment of the display rack illustrating another way of securing a secondary rail to the display rack.

FIGS. 9A-9B illustrate another embodiment of a display rack 201 for supporting containerized plants 103 in an upright orientation. The display rack 201 is substantially identical to the display rack 101 with the addition of a secondary rail 241 releasably secured to the rail supports 133 to extend longitudinally in spaced relationship, and more suitably parallel spaced relationship, with one of the additional rails 141 above the support surface 139 on which the display rack stands. For example, as illustrated in FIG. 9B the secondary rail 241 has short arms 227 (FIG. 9B) that are received in open ends 253 of the frame elements 147 of the frame 145. A locking system (not shown), such as a set screw, pin or other suitable locking system may be used to hold the arms 227 in the frame elements 147. In the illustrated embodiment, the frame 145 is constructed so that the opening 253 is into a substantially horizontal frame element 147. The secondary rail 241 and additional rail 141 define a space therebetween for receiving additional containerized plants (e.g., smaller containerized plants) for support by the rails 241, 141 as illustrated in FIG. 9A. Although the illustrated embodiment includes only one secondary rail 241, it understood that an identical secondary rail may be added to the opposite side of the rack. As illustrated in FIG. 9C, a secondary rail 241' may have L-shaped arms 227' that are receivable into openings 253' into vertical frame elements of the frame 145 to secure the secondary rail to the rack 201 without departing from the scope of the invention.

Figure 10:
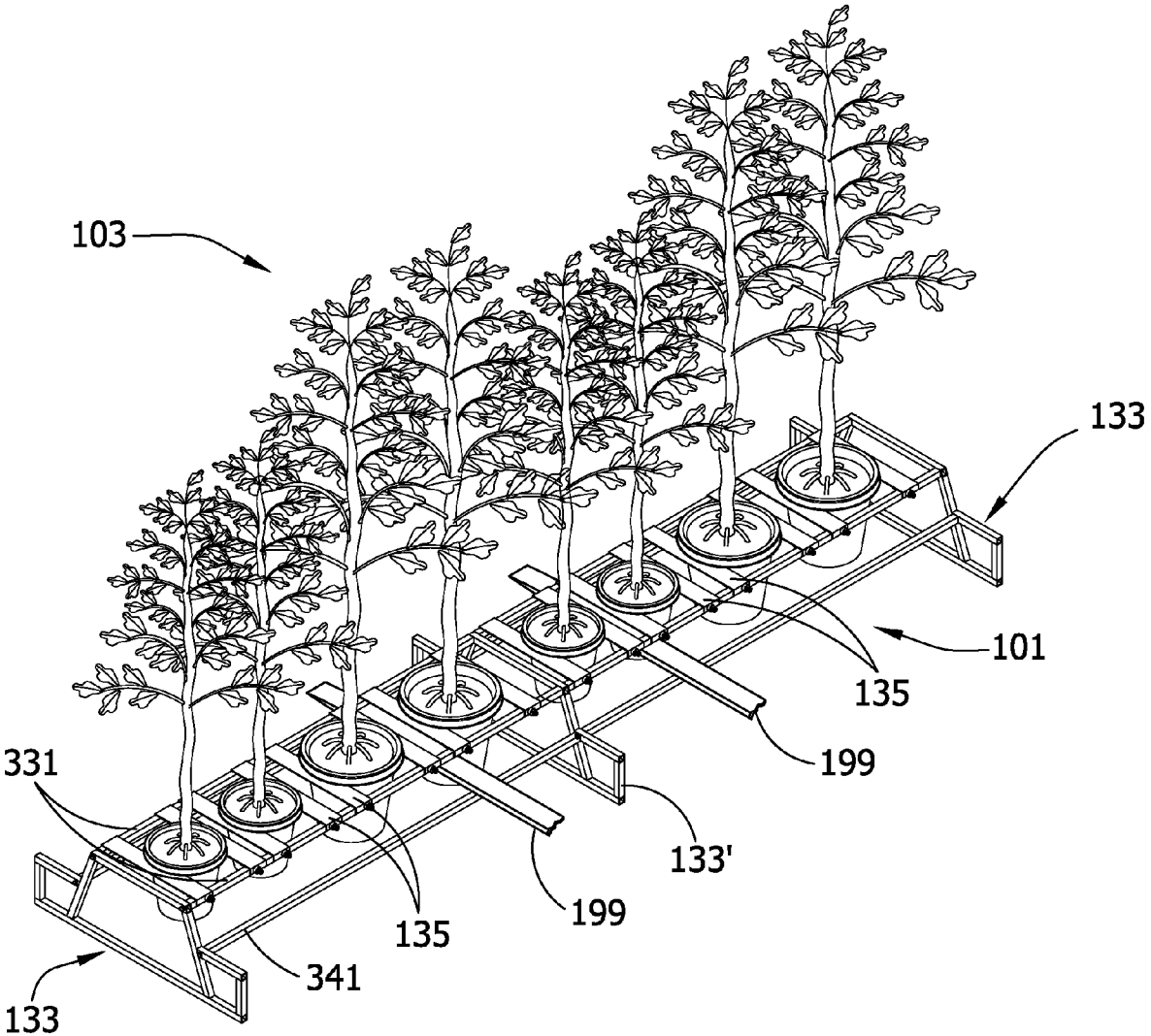
FIG. 10 is a perspective of one embodiment of a modular display system for supporting a plurality of containerized plants.
Figure 11:
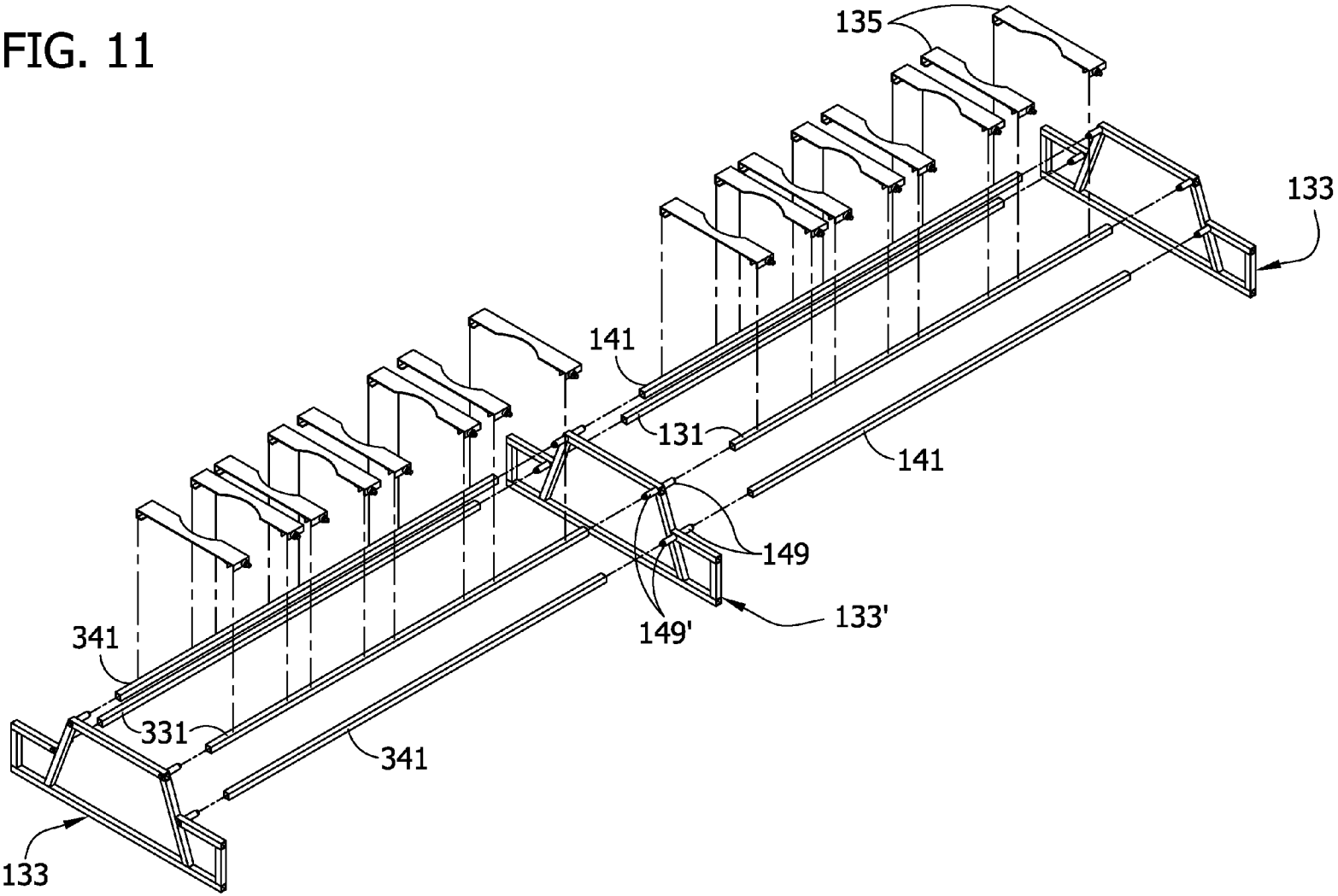
FIG. 11 is an exploded view of the display system of FIG. 10.

The display racks 101, 201 described above and illustrated in the various drawings are also suitably constructed for configuration into a modular display system. One embodiment of a such a modular display system 301 is illustrated in FIGS. 10 and 11. The display system 301 suitably comprises an entire display rack, such as the display rack 101 of FIGS. 1-6, with an additional rail support 133', brace rails 331 and additional rails 341 arranged longitudinally adjacent to the rack 101 and connected thereto. In particular, as best illustrated in FIG. 11, additional rail mounts 149' are provided on the opposite face of one of the rail supports 133 of the display rack 101 so that the brace rails 331 and additional rails 341 are supported by the additional rail support 133' and the rail support 139 of the display rack 101. In such a configuration, the entire modular display system 301 may be lifted by a fork lift 199 to carry the system and the containerized plants 103 therein to other locations.

When introducing elements of the present invention or the preferred embodiments thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions and methods without departing from the scope of the invention, it is intended that all matter described herein and shown in the accompanying drawings shall be interpreted as illustrative and not in a limiting sense.

What is claimed is:

1. A display rack for supporting a containerized plant, the display rack comprising:

rail supports for supporting the display rack on a support surface;

at least two elongate brace rails extending longitudinally of the display rack and supported by the rail supports in transversely spaced relationship with each other above the support surface; and at least one pair of cross-braces extending transversely between and supported by the brace rails above the support surface, each of the cross-braces having an arcuate side segment for conformally engaging opposite sides of a container of said containerized plant to support said containerized plant in an upright orientation thereof, at least one of the cross-braces being slideable longitudinally on said brace rails to selectively adjust the longitudinal location of said cross-brace on said brace rails, wherein each of the rail supports has a base for engaging the support surface at locations spaced transversely from one another a distance greater than a distance between the transversely spaced brace rails.

2. The display rack set forth in claim 1 wherein each of the cross braces comprises a support member extending between the brace rails and mounting assemblies for slideably mounting the cross brace on the brace rails, the mounting assemblies for each of the cross braces including flanges extending down along outsides of the brace rails, one of the mounting assemblies for each of the cross braces further comprising a transverse member extending inward from the flange and spaced from the support member to extend under the respective brace rail.

3. The display rack set forth in claim 2 wherein the other of the mounting assemblies for each of the cross braces further comprises a stop member extending down from the support member on an opposite side of the respective brace rail from the flange of said other mounting assembly.

4. The display rack set forth in claim 3 wherein each of the cross-braces comprises a locking system operable to selectively inhibit movement of the cross brace along the brace rails.

5. The display rack set forth in claim 1 wherein at least one of the cross-braces is removable from at least one of the brace rails.

6. The display rack set forth in claim 5 wherein the at least one removable cross-brace is removeable from at least one of the brace rails without separating said at least one of the brace rails from either of the rail supports.

7. The display rack set forth in claim 1 in combination with a container containing a tree, wherein the container has a side wall, the arcuate side segments of the pair of cross braces engaging the container sidewall on opposite sides of the container and supporting the tree in an upright position.

8. The display rack and container combination set forth in claim 7 wherein the container has a base and a side wall, the display rack supporting the container so the base of the container is spaced up off of the support surface.

9. The display rack set forth in claim 1 in combination with multiple containers, each of the containers containing a tree, the rack comprising a pair of cross-braces for each container, the cross braces extending transversely between and supported by the brace rails above the support surface, the cross braces of each pair having arcuate side segments for engaging opposite sides of the respective container to support the respective tree in an upright orientation, at least one of the cross-braces of each pair being slideable longitudinally on said brace rails to selectively adjust the longitudinal location of said cross-brace on said brace rails.

10. The combination of display rack and multiple containers as set forth in claim 9 wherein at least one of the containers is a different size from at least one other container.

11. The display rack set forth in claim 1 wherein the display rack further comprises a pair of auxiliary rails extending between and supported by the rail supports above the support surface at an elevation below the brace rails, the auxiliary rails being positioned on opposite sides of the brace rails and spaced transversely from one another a distance that is greater than the distance between the transversely spaced brace rails.

12. The display rack set forth in claim 11 further comprising a further auxiliary rail extending between and supported by the rail supports at an elevation below the brace rails, the further auxiliary rail being positioned generally alongside and spaced transversely from one of the rails of said pair of auxiliary rails.

13. The display rack set forth in claim 1 further comprising a locking system operable to inhibit movement of the at least one cross-brace relative to the brace rails.

14. The display rack set forth in claim 1 wherein at least one of the brace rails is rectangular in cross-section.

15. The display rack set forth in claim 1 wherein each of the brace rails is tubular, having longitudinally opposite ends, an interior channel therein and being open at said longitudinally opposite ends, the display rack further comprising mounting pins secured to the at least one rail support and sized for being received in the channel of said brace rail to releasably connect the brace rail to the at least one support rail.

* * * * *